United States Patent [19]

Hasegawa et al.

[11] 4,259,426

[45] Mar. 31, 1981

[54] PRESSURE FIXABLE MICROCAPSULE TONER AND ELECTROSTATIC IMAGE DEVELOPING METHOD

[75] Inventors: Tetsuo Hasegawa, Tokyo; Shigeo Kato, Noda; Yoshihiro Nishikawa, Kawasaki, all of Japan

[73] Assignee: Canon Kabushiki Kaisha, Tokyo, Japan

[21] Appl. No.: 18,289

[22] Filed: Mar. 6, 1979

[30] Foreign Application Priority Data

| | | | |
|---|---|---|---|
| Mar. 6, 1978 | [JP] | Japan | 53/25295 |
| Mar. 10, 1978 | [JP] | Japan | 53/27385 |
| Jul. 27, 1978 | [JP] | Japan | 53/92236 |

[51] Int. Cl.[3] ..... G03G 13/20

[52] U.S. Cl. ..... 430/98; 430/111; 430/904; 430/107; 430/138; 428/403; 252/316; 430/903

[58] Field of Search ..... 430/111, 903, 109, 904, 430/98, 107, 138; 252/316

[56] References Cited

U.S. PATENT DOCUMENTS

| | | | |
|---|---|---|---|
| 2,953,470 | 9/1960 | Green et al. | 430/8 |
| 3,639,245 | 2/1972 | Nelson | 430/109 |
| 3,674,736 | 7/1972 | Lerman et al. | 430/137 |
| 3,910,846 | 10/1975 | Azar et al. | 430/111 |
| 3,938,992 | 2/1976 | Jadwin et al. | 430/107 |
| 4,122,024 | 10/1978 | Jones et al. | 430/111 |

OTHER PUBLICATIONS

Orr, Jr. et al., Fine Particle Measurement, McMillian, (1965), pp. 3–4.

*Primary Examiner*—John D. Welsh

*Attorney, Agent, or Firm*—Fitzpatrick, Cella, Harper & Scinto

[57] ABSTRACT

A pressure fixable capsule toner encapsulated with an insulating material is featured by a main particle size located within a range from 5 to 25$\mu$, by a particle size distribution that at least 70% in number of the toner particles are within a size range of $\pm 3\mu$ of the main particle size, and by a relationship $0.02 \leqq (a-b)/b \leqq 0.4$ wherein a and b respectively stand for the main particle size of the capsule toner and core material in microns.

10 Claims, No Drawings

PRESSURE FIXABLE MICROCAPSULE TONER AND ELECTROSTATIC IMAGE DEVELOPING METHOD

BACKGROUND OF THE INVENTION

1. Field of the Invention

The present invention relates to a toner for developing an electrostatic latent image in an electrophotographic, electrostatic recording or electrostatic printing process, and more particularly to capsule toners adapted for pressure fixing.

2. Description of the Prior Art

In various electrophotographic processes as already disclosed in the U.S. Pat. Nos. 2,297,691, 2,825,814, 3,220,324 and 3,220,831 and British Pat. Nos. 1165406 and 1165405, an image reproduction is obtained by forming an electric latent image by various methods generally on a photoconductive material, developing said latent image with a toner, if desired transferring thus obtained toner image onto a transfer material such as paper, and finally fixing said image by heating, pressure or solvent vapor.

Such electric latent image can be rendered visible by various methods.

For example, there are already known a magnetic brush method as disclosed in the U.S. Pat. No. 2,874,063, a cascade development method as disclosed in the U.S. Pat. No. 2,618,552, a powder cloud development method as disclosed in the U.S. Pat. No. 2,221,776, a touch-down development method as disclosed in the U.S. Pat. No. 2,895,847, a fur brush development method, a liquid development method etc. The toner employed in such development methods has been a finely divided material composed of a natural or synthetic resin in which dyes or pigments are dispersed. Also there is also known to add a third material to such toner for various purposes.

The developed toner image is transferred onto a transfer material such as paper, if desired and finally fixed thereon.

Such image fixation is already known to be achievable by heat melting said toner with a heater or a heat roller and thus adhering said toner to a substrate, by softening or dissolving the binder resin of said toner with an organic solvent to obtain such adhesion, or by adhering the toner to the substrate by pressure.

In general, each toner is specifically designed for one developing method and is not applicable to other developing methods. Particularly the toner designed for the widely employed heat fixing method with a heater is scarcely applicable to other fixing methods such as heat roller fixation, solvent fixation or pressure fixation. For this reason various toners have been developed for such fixing methods.

The pressure fixation of toner, as disclosed in the U.S. Pat. No. 3,269,626 and in the Japanese Patent Publication Sho No. 46-15876, has various advantages such as economy in energy, absence of pollution, possibility of immediate copying without waiting time after power supply to the copying machine, absence of danger of copy scorching, possibility of high-speed fixation and simpler structure of fixing device.

However this fixing method is also associated with various troubles such as insufficient fixability of toner, toner offsetting to the pressurizing roller or adhesion of paper to said roller, and various trials have therefore been made to improve the pressure fixability.

For example there are already proposed a pressure fixable toner comprising an aliphatic component and a thermoplastic resin as disclosed in the British Pat. No. 1210665, a pressure fixable encapsulated toner with a soft core material as disclosed in the U.S. Pat. Nos. 3,788,994, 3,893,932 and 3,974,078, and in the Japanese Patents Laid-Open Sho No. 49-17739 and Sho No. 52-108134, and a pressure fixable toner utilizing a block copolymer of a tenace polymer and a soft polymer as disclosed in the Japanese Patent Laid-Open Sho No. 48-75033.

It has however been unable to obtain a practically satisfactory pressure fixable toner providing a sufficient pressure fixability, free from image offsetting or adhesion of paper to the pressurizing roller, stable in developing and fixing performance after repeated use, free from sticking to the carrier, metal sleeves or photosensitive member and provided with a satisfactory shelf life without coagulation or caking during storage.

For example a pressure fixable toner composed of a soft material, though showing a relatively good fixation by pressure, is associated with various troubles such as difficulty of crushing in preparation of toner particles, tendency of causing offsetting to the pressurizing roller or sticking to the carrier or photosensitive member, and coagulation or caking during storage.

Also the conventionally known pressure fixable capsule toners have been unsatisfactory in the practical performance since a soft core material showing a satisfactory pressure fixability will gradually deposit on the pressurizing roller after repeated fixing operations to cause toner off-setting or paper adhesion to said roller, while the fixing performance becomes deteriorated if such drawback is avoided.

Also in a recently employed developing method utilizing a single-component developer which is composed solely of toner particles containing magnetic minute particles therein and is free from carrier particles, the binder resin for said toner is required to provide satisfactory dispersibility for and adhesion to said magnetic particles as well as high impact strength and flowability in toner, which are not easily rendered compatible with the pressure fixing performance.

SUMMARY OF THE INVENTION

The object of the present invention is to provide a pressure fixable toner showing satisfactory and stable pressure fixability on ordinary plain paper and maintaining stable developing and fixing performance even after repeated developing operations.

Another object of the present invention is to provide a pressure fixable toner free from offsetting on the pressurizing roller or from adhesion on the carrier, developing sleeve, photosensitive member etc.

Still another object of the present invention is to provide a pressure fixable toner of excellent storage stability, free from coagulation or caking during use or storage.

Still another object of the present invention is to provide a pressure fixable toner showing satisfactory and stable chargeability throughout the use thereby allowing to obtain a clear image without background fog.

Still another object of the present invention is to provide a pressure fixable toner capable of showing satisfactory pressure fixability and magnetic behavior and still being electrostatically transferable when used as a magnetic toner containing magnetic particles.

Still another object of the present invention is to provide a pressure fixable toner provided with satisfactory durability and flowability.

Still another and particular object of the present invention is to provide an excellent pressure fixable capsule toner wherein the aforementioned drawbacks are avoided by defining the ratio of shell thickness to the core material and also defining the particle size distribution in a conventional pressure fixable capsule toner.

The foregoing objects are achieved by a pressure fixable capsule toner encapsulated with an insulating material which is featured by a main particle size located within a range from 5 to 25$\mu$, by a particle size distribution that at least 70% in number of the toner particles are within a size range of $\pm 3\mu$ of the main particle size, and by a relationship $0.02 \leqq (a-b)/b \leqq 0.4$ wherein a and b respectively stand for the main particle size of the capsule toner and core material in microns.

DESCRIPTION OF THE PREFERRED EMBODIMENTS

It is known that the performance of a pressure fixable capsule toner is influenced by the ratio of the core material for obtaining the pressure fixability and the shell material for improving the chargeability and flowability, but in the present invention it has further been found that the particle size distributions of the core material and of toner particles and the shell thickness are mutually correlated and have to satisfy a preferred relationship in order to obtain a satisfactory pressure fixable capsule toner.

Stated differently it is not possible to constantly obtain a satisfactory capsule toner of stable performance simply by employing a core material of a satisfactory pressure fixability and a shell material of satisfactory chargeability and flowability and by defining the bulk ratio of said core material to said shell material. This has been found due to a fact that each toner particle is not necessarily provided with a preferred ratio of the core material to the shell material since the core material has a certain particle size distribution while the completed capsule toner particles also have another particle size distribution. Consequently it is not possible to obtain a capsule toner of stable performance even if the capsule toner particles are classified in size to obtain a determined particle size distribution.

Thus, in order to achieve constant pressure fixability, chargeability and flowability, it has been found necessary to carefully control the particle size distribution of the core material, that of the capsule toner particles and the ratio of the core material to the shell material so as to satisfy certain conditions.

More specifically it has been found in the present invention, as already explained in the foregoing, that the capsule toner of stable performance can be constantly obtained when the main particle size thereof is selected within a range from 5 to 25$\mu$, when the number of toner particles within a particle size range of $\pm 3\mu$ of the main particle size is at least 70%, preferably at least 80%, of the total number of toner particles and when the main particle size a of the capsule toner and the main particle size b of the core material, both in microns, satisfy the following relation $0.02 \leqq (a-b)/b \leqq 0.4$, preferably $0.05 \leqq (a-b)/b \leqq 0.3$.

The main particle size used herein means a particle size having the maximum number of particles in a particle size distribution, wherein the number of particles of a given particle size can be determined by a particle size analyzer. In such analyzer, an optically magnified image of the particles to be measured is converted through a television camera to video signals, which are further converted to binary coded image signals in a threshold circuit and sent to a counting circuit for measuring the number and size of the particles by means of the scanning lines. The obtained results are averaged over five samples.

An example of such particle size analyzer is known under a trade name of LUZEX 450 manufactured by Nippon Regulator Co.

In case of preparing the capsule toner by at first forming particles of the core materials and then coating said particles with the shell material, it is particularly desirable to classify the particles of the core material within a particle size range of $\pm 3\mu$ of the main particle size prior to the coating with the shell material, and to repeat the classification after the capsule toner is completed. However such classifications may be dispensed with if the aforementioned conditions of the present invention can be satisfied by suitable selection of the capsule manufacturing conditions. The conformity to the conditions of the present invention can be verified, after the preparation of the capsule toner, by measuring the main particle size of the core material after removal of the capsule shell with a solvent capable of dissolving the shell material but not the core material.

In the foregoing equation, a value of $(a-b)/b$ smaller than 0.02 will result in a deteriorated chargeability leading to enhanced coagulation and significantly deteriorated durability, while a value higher than 0.4 still result in a significant deterioration of the pressure fixability. Also it becomes not possible to constantly obtain stable performance of the toner if more than 30% of the particles are outside the particle size range of $\pm 3\mu$ of the main particle size.

The pressure fixable component to be employed as the core material in the present invention can be suitably selected from the core materials used in the conventional pressure fixable capsule toners, and can be composed of a material adhesive under an elevated pressure or at normal temperature and pressure, or a suitable mixture of such materials. In the present invention it is thus possible to utilize any material showing pressure fixing property, of which examples are disclosed, for instance, in the British Pat. No. 1210665, U.S. Pat. Nos. 3,788,994 and 3,974,078, and Japanese Patents Laid-Open Sho No. 49-17739, Sho No. 52-108134 and Sho No. 48-75033.

Particularly preferred examples of such material are higher fatty acids such as stearic acid, palmitic acid or lauric acid; polyolefines such as low-molecular polyethylene, low-molecular polypropylene, oxidized polyethylene or polytetrafluoroethylene; low-molecular polystyrene; epoxy resins; polyester resins with an oxidation value not exceeding 10; styrene-butadiene copolymers with a monomer ratio from 5:95 to 30:70; ethylene-acrylic acid copolymer; ethylene-methacrylic acid copolymers; ethylene-vinyl acetate copolymers; polyvinylpyrrolidone; methylvinylether-maleic anhydride copolymers; maleic acid-modified phenolic resins, phenol-modified terpene resins etc.

A particularly preferred material excellent in pressure fixability and in other properties is oxidized high density polyethylene (density higher than 0.95 g/cm$^3$ preferably higher than 0.97 g/cm$^3$) with a melt index higher than 100, preferably higher than 200. The preparation of this particular polyethylene is detailedly disclosed in the U.S. Pat. No. 3,339,850. The density of the oxidized polyethylene is conducted according to the method defined in ASTMD1505-57T. Also the melt index (MI) is determined by the measurement of flow rate F under the condition D according to ASTMD1238-57T and by the following equation log $MI=0.921 \cdot \log F+1.039$.

The above-mentioned oxidized polyethylene is found to be particularly preferably for the purpose of the present invention when it has a solftening point higher than 100° C. to be determined according to the method defined by ASTM-E28, and when it is of a low molecular weight with an acid value higher than 20.

A melt index smaller than 100 will significantly deteriorate the pressure fixability onto plain paper, while a density lower than 0.95 g/cm$^3$ will also lead to a deteriorated pressure fixability.

As the insulating shell material there can be employed various resins which are preferably provided with appropriate film-forming property, negative or positive chargeability, flowability without coagulation and not hindering the pressure fixability of the core material.

Examples of such resins are polymers or copolymers of styrene or substituted styrene such as polystyrene, poly-p-chlorostyrene, polyvinyltoluene, styrene-butadiene copolymers, styrene-acrylic acid copolymers or styrene-maleic anhydride copolymers, polyester resins, acrylic resins, xylenic resins, polyamide resins, ionomer resins, furane resins, ketone resins, terpene resins, rosin, rosin-modified pentaerythritol esters, natural resin-modified phenolic resins, natural resin-modified maleic acid resins, cumarone-indene resins, alicyclic hydrocarbon resins, petroleum resins, phthalate acetate cellulose, starch graft polymers, polyvinylbutyral, polyvinyl alcohol etc., which can be employed singly or as a mixture thereof. Among these materials particularly preferred are styrenic resins, polyester resins, ionomer resins, phthalate acetate cellulose, starch graft polymers and polyvinylbutyral with an average molecular weight higher than 1500.

In case the affinity or adhesion is insufficient between the core material and the shell material, there may be provided an intermediate adhesion layer.

In the present invention the shell material is required to cover the core material to an extent to satisfy the toner performance such as chargeability and flowability and need not necessarily cover the core material entirely.

Also the insulating shell material may contain a suitable amount of a charge controlling agent such as a metal-containing dye or nigrosin conventionally employed in the toner.

Also such charge controlling agent may be added in a fine powder form to the capsule toner and admixed therewith.

Furthermore any coloring material such as dye or pigment conventionally employed in the toners is applicable also in the capsule toner of the present invention, and may be added to the core material and/or the shell material.

Also for obtaining a magnetic toner, the toner of the present invention can be added with fine magnetic particles of an average particle size of ca. 0.1 to 5 microns. Such magnetic particles can be composed of any magnetic or magnetizable material for example powdered metal such as manganese, nickel, cobalt, iron or chromium, ferrites, manganese alloys and compounds or other conventionally known ferromagnetic alloys. Such magnetic particles may be added either to the core material or to the shell material, but preferably to the former for obtaining an insulating toner. The amount of addition is within a range of 1 to 50%, preferably 5 to 30% with respect to the toner weight.

The image obtained with the capsule toner of the present invention is fixed by passage between a pair of mutually pressed rollers, eventually with auxiliary heating. The pressure applied is generally within a range of ca. 15 to 30 kg/cm and can be applied by a device for example disclosed in the Japanese Patent Publication Sho No. 44-12797, U.S. Pat. Nos. 3,269,626, 3,612,682, 3,655,282 and 3,731,358.

The present invention will further be clarified by the following examples, in which the amounts are represented by parts by weight.

EXAMPLE 1

A mixture of: 100 parts oxidized polyethylene (density 0.99, melt index 1000) and 10 parts carbon black was sufficiently mixed in a roll mill for 30 minutes at ca. 150° C. and crushed then in a jet crusher to obtain finely powdered core material of a main particle size of 14.5 microns. Successively said core material was classified in such a manner that at least 90% of the particles are within a particle size range of ca. 11.5 to 17.5 microns.

Thus obtained core material particles were then dispersed in 5% xylene solution of a cyclized rubber known under a trade name of ALPEX CK450 supplied from Hoechst AG, collected by filtration and dried for 60 minutes at 80° C. to form an extremely thin intermediate adhesive layer.

Thus prepared particles were then sufficiently dispersed in 10% cyclohexane solution of a styrene-butadiene copolymer (15:85 in weight ratio), collected again by filtration, dispersed in a 1:9 mixture of cyclohexane and n-hexane and spray dried to obtain a capsule toner which showed a main particle size of 16.3 microns and a ratio $(a-b)/b$ equal to 0.144. Also 86% of the toner particles were found to be within a particle size range of $\pm 3\mu$ with respect to the main particle size. 10 Parts of thus prepared capsule toner were admixed with 90 parts of iron power carrier known under a trade name of EFV200/300 manufactured by Nippon Teppun Co. to obtain a developer.

Said developer was tested in continuous copying in a dry electrophotographic copier known under a trade name of NP-5000 manufactured by Canon K.K. in which the fixing device was replaced by a pair of chromium-plated rigid rollers supplied by Develop Co. and providing a total pressure of 460 kg.

It was found that said developer was capable of providing satisfactorily fixed clear image without background fog and substantially maintaining the initial image quality and fixability even after 50,000 continuous copies.

The result of fixability test was rated as grade 5, according to the dye fastness test against friction defined in the standard JIS-LO849-1971, in which the toner fixed surface is rubbed against a white cotton cloth under a determined manner on a friction tester and the coloration on said cotton cloth is compared with a standard gray scale to rate the fastness of fixation in various grades.

Also the shell thickness in the foregoing example was varied to obtain the following results:

| Example | a(μ) | b(μ) | (a − b)/b | fixability | durability |
|---|---|---|---|---|---|
| 1 | 16.3 | 14.5 | 0.12 | (grade) 5 | >50,000 (copies) |
| 2 | 19.7 | 14.5 | 0.36 | 4–5 | >50,000 |
| 3 | 18.1 | 14.5 | 0.25 | 5 | >50,000 |
| 4 | 15.9 | 14.5 | 0.10 | 5–6 | 50,000 |
| 5 | 15.2 | 14.5 | 0.05 | 5–6 | 40,000 |
| Ref. Ex. | | | | | |
| 1 | 14.7 | 14.5 | 0.01 | 5–6 | 1,000 |
| 2 | 21.0 | 14.5 | 0.45 | 2–3 | >50,000 |

Without the classification of the core material in the preceding examples 1 to 5, the percentage of particles within the range of ±3μ of the main particle size was reduced to ca. 60 to 63%, and the fixability was reduced by 1 or 2 grades, particularly in blacked out image areas.

EXAMPLES 6–15 AND REFERENCE EXAMPLES 3–6

The processes of the Examples 1 to 5 and the Reference Examples 1 to 2 were reproduced except that the shell materials were replaced by phthalate acetate cellulose (supplied by Wako Chemical Co.) dissolved in acetone and by a styrene-maleic anhydride-butyl acrylate copolymer (monomer ratio 50:15:35 in weight) (trade name STYLITE X-4 supplied by Daido Kogyo Co.) dissolved in methylethylketone to obtain comparable results.

EXAMPLES 16–18 AND REFERENCE EXAMPLES 7–9

The process of the Example 1 was reproduced with the following core and shell materials:

| Example | Core material | b(μ) | Shell material | a(μ) | a − b/b | Fixability |
|---|---|---|---|---|---|---|
| 16 | polytetrafluoroethylene (Lubron L-5 Daikin Kogyo) | 12.0 | styrene-butadiene copolymer (monomer ratio 15:85 wt. %) (solution in MEK) | 14.7 | 0.23 | 5 (grade) |
| Ref.Ex.7 | polytetrafluoroethylene (Lubron L-5 Daikin Kogyo) | 12.0 | Styrene-butadiene copolymer (monomer ratio 15:85 wt. %) (solution in MEK) | 17.6 | 0.47 | 2–3 |
| 17 | ethylene-vinyl acetate copolymer (AC-410, Allied Chemical) | 10.4 | styrene-butadiene copolymer (monomer ratio 15:85 wt. %) (solution in MEK) | 12.6 | 0.21 | 3–4 |
| Ref.Ex.8 | ethylene-vinyl acetate copolymer (AC-410, Allied Chemical) | 10.4 | styrene-butadiene copolymer (monomer ratio 15:85 wt. %) (solution in MEK) | 16.8 | 0.61 | 1 |
| 18 | stearic acid | 7.5 | polyvinyl alcohol (solution in ethanol) | 9.1 | 0.20 | 4 |
| Ref.Ex.9 | stearic acid | 7.5 | polyvinyl alcohol (solution in ethanol) | 11.3 | 0.50 | 1–2 |

EXAMPLE 19

The process of the Example 1 was reproduced except that 10 parts of carbon black were replaced by 30 parts of magnetite known under a trade name of EPT-1000 manufactured by Toda Kogyo Co. to obtain a single-component magnetic capsule toner.

Thus prepared magnetic capsule toner was singly used in copying test on a dry electrophotographic copier known under a trade name of NP-5000 manufactured by Canon K.K. in which the fixing device was replaced by a pair of chromium plated rigid fixing rollers manufactured by Develop Co. and providing a total pressure of 460 kg. In this test the above-mentioned toner was found to provide a satisfactorily fixed clear image without background fog, and to substantially maintain the initial image quality and fixability even after 30,000 copying operations. The result of the fixability test was rated as the grade 4 to 5.

EXAMPLES 20–26

The process of the Example 19 was reproduced with the following resin compositions. All the toners obtained provided satisfactorily fixed clear images.

| Example | Oxidized polyethylene | | Shell resin | Fixability |
|---|---|---|---|---|
| 20 | d | 0.99 | ionomer resin | 3–4 |
| | M.I. | 400 | | (grade) |
| 21 | d | 0.97 | polyester resin | 4–5 |
| | M.I. | 650 | | |
| 22 | d | 0.955 | styrene-butadiene | 4–5 |
| | M.I. | 1500 | copolymer | |
| 23 | d | 0.99 | phthalate acetate | 3–4 |
| | M.I. | 150 | cellulose | |
| 24 | d | 0.955 | maleic acid-modified | 4–5 |
| | M.I. | 4800 | phenolic resin | |
| 25 | d | 0.99 | styrene-maleic anhyd- | 4–5 |

-continued

| Example | Oxidized polyethylene | | Shell resin | Fixability |
|---|---|---|---|---|
| | M.I. | 1000 | ride copolymer | |
| 26 | d | 0.99 | oxidized starch grafted | 4–5 |
| | M.I. | 1000 | polystyrene resin | |

EXAMPLE 27

A mixture of:

| | |
|---|---|
| 50 parts | oxidized polyethylene (density 0.99; melt index 1000) |
| 50 parts | ethylene-acrylic acid copolymer |
| 5 parts | oxidized starch |
| 1000 parts | toluene |

was blended for one day in a porcelain ball mill, and the resulting solution was spray dried at 80° C. to obtain a toner with a particle size range of 8 to 12 microns, with the average size at ca. 10 microns. Said toner showed a triboelectricity of $-10\ \mu c/g$. 10 parts of said toner were mixed with 90 parts of iron powder known under a trade name of EFV 250–400 supplied by Nippon Teppun Co. to obtain a developer, which was tested in a commercially dry electrophotographic copier known under a trade name of NP-5000 manufactured by Canon K.K. in which the fixing device was replaced by a pair of chromium plated rigid fixing rollers providing a total pressure of 460 kg. The toner was found to provide clear fog-free image and to substantially maintain the initial image quality even after 100,000 copying operations, without any toner offsetting or paper adhesion to the pressurizing rollers. The result of the fixability test was rated as grade 4 to 5.

EXAMPLE 28

A mixture of:

| | |
|---|---|
| 100 parts | oxidized polyethylene (density 0.99; melt index 1000, acid value 20; average molecular weight 4000) |
| 30 parts | magnetite (trade name EPT-1000, Toda Kogyo) |

was blended for 30 minutes in a roll mill at 140°–150° C. and crushed in a jet crusher to obtain an insulative magnetic toner of a particle size range of 5 to 20 microns. 20 parts of thus obtained toner were mixed with 1 part of finely powdered oxidized starch known under a trade name of PETROCOAT RJ in a mixer to obtain a developer. Said developer was tested in development in a similar manner as in the Example 19, and a very clear fog-free image could be obtained by transferring the developed image by corona discharge onto a plain paper followed by pressure fixation. The result of the fixability test was rated as grade 4 to 5.

EXAMPLES 29–34

The process of the Example 28 was reproduced with the following resin compositions. All the obtained toners showed satisfactory pressure fixability.

| Example | Oxidized polyethylene | | Blend resin | Fixability |
|---|---|---|---|---|
| 29 | d | 0.97 | polyester resin | 3–4 (grade) |
| | M.I. | 550(30 parts) | (70 parts) | |
| 30 | d | 0.96 | polystyrene | 4–5 |
| | M.I. | 1000(60 parts) | (40 parts) | |
| 31 | d | 0.99 | — | 5 |
| | M.I. | 1000(100 parts) | | |
| 32 | d | 0.97 | — | 4–5 |
| | M.I. | 2600(100 parts) | | |
| 33 | d | 0.955 | polystyrene-maleic anhydride copolymer (50 parts) | 4 |
| | M.I. | 4800(50 parts) | | |
| 34 | d | 0.99 | polyester resin | 4–5 |
| | M.I. | 200(80 parts) | (20 parts) | |

What we claim is:

1. In a process for developing a latent electrostatic image comprising contacting said image with a developer and then fixing said developed image using pressure rollers, the improvement of using as the developer a composition wherein the toner component thereof comprises a pressure fixable capsule toner composed of encapsulated particles each composed of a pressure fixable core material coated with an insulating shell material, which comprises having a main particle size of said capsule toner within a range from 5 to 25$\mu$ and a particle size distribution that the number of toner particles within a particle size range of $\pm 3\mu$ with respect to said main particle size is at least 70% of the total number of toner particles, and satisfying a relation $0.02 \leqq (a-b)/b \leqq 0.4$ wherein a and b respectively stand for the main particle sizes of capsule toner particle and core material in microns.

2. The process according to the claim 1, wherein the number of toner particles within a particle size range of $\pm 3\mu$ with respect to said main particle size is at least 80% of the total number of toner particles.

3. The process according to the claim 1, further satisfying a relation $0.05 \leqq (a-b)/b \leqq 0.3$.

4. The process according to the claim 1, wherein said core material being a polyolefin.

5. The process according to claim 1, wherein said core material comprises a finely divided magnetic material.

6. The process according to the claim 4, wherein said polyolefin being oxidized polyethylene of a melt index at least equal to 100 and a density at least equal to 0.95 g/cm$^3$.

7. In a process for developing a latent electrostatic image comprising contacting said image with a developer and then fixing said developed image using pressure rollers, the improvement of using as the developer a composition wherein the toner component thereof comprises a pressure fixable toner comprising oxidized polyethylene of a melt index at least equal to 100 and of a density at least equal to 0.95 g/cm$^3$ as a toner binder.

8. The process employing a pressure fixable toner according to the claim 7 comprising oxidized polyethylene with a melt index at least equal to 200.

9. The process employing a pressure fixable toner according to the claim 7 comprising oxidized polyethylene with a density at least equal to 0.97 g/cm$^3$.

10. The process employing a pressure fixable toner according to the claim 7 comprising oxidized polyethylene with an acid value at least equal to 20.

* * * * *